US005524666A

United States Patent [19]

Linn

[11] Patent Number: 5,524,666

[45] Date of Patent: Jun. 11, 1996

[54] WATER CONSERVATION SYSTEM

[75] Inventor: Mark S. Linn, Virginia Beach, Va.

[73] Assignee: Mark Stephen Linn, Virginia Beach, Va.

[21] Appl. No.: 510,241

[22] Filed: Aug. 2, 1995

[51] Int. Cl.[6] ..... F16K 49/00

[52] U.S. Cl. ..... 137/337; 137/434; 126/362; 236/12.12

[58] Field of Search ..... 137/337, 434, 137/334; 236/12.12; 126/362

[56] References Cited

U.S. PATENT DOCUMENTS

| | | | |
|---|---|---|---|
| 3,799,181 | 3/1974 | Maddren | 137/337 |
| 4,870,986 | 10/1989 | Barrett et al. | 137/337 |
| 5,105,846 | 4/1992 | Britt | 137/337 |
| 5,261,443 | 11/1993 | Walsh | 137/337 |
| 5,339,859 | 8/1994 | Bowman | 137/337 |

*Primary Examiner* A. Michael Chambers

[57] ABSTRACT

Domestic water conservation piping system has thermostatically controlled diverter valve in series with water heater and shower head and/or a hot water shunt tube extending from the hot water heater to the fixture hot water supply in parallel with the thermostat piping. When low temperature water is detected in the "hot water" line, the thermostatically controlled diverter valve diverts the low temperature water to a secondary water closet which stores the water at atmospheric pressure. The secondary water closet provides make-up water to a toilet's primary water closet. When the thermostatically controlled diverter valve senses high temperature water, the line tot he secondary water closed is closed, and the hot water is diverted to the shower head

7 Claims, 13 Drawing Sheets

WATER CONSERVATION SYSTEM

FIELD OF INVENTION

The present invention relates to a water conservation system. More particularly, the present invention relates to a system for diverting, and/or conserving for subsequent use, low temperature water within a domestic hot water line.

BACKGROUND

The specific embodiment disclosed herein sets forth a water conservation system as it might be utilized in a domestic (i.e. household) plumbing system. However, it should be understood that the disclosed water conservation system is applicable to other environments.

It is a well known occurrence that during periods of non-use, the high temperature water in domestic hot water pipe lines cools down, approaching (if not reaching) ambient temperature. Typically, this slug of cooled down, formerly heated, water occupies the volume of the "hot water" pipe line which is down stream from the domestic water heater and upstream of a domestic "hot water" spigot, faucet, or shower head (or combination of such fittings).

When the aforementioned "hot water" spigot, faucet or shower head is initially opened, this slug of cooled down water must first be purged from the "hot water" line before truly heated water begins to flow from the fitting. When the slug of cooled down water is released from a faucet or from a domestic shower head, the slug of water may be unbearably uncomfortable for personal use and showering. Thus, in most instances, people will allow the entire slug of cooled down water in the "hot water" pipe line to exit through the faucet or shower head, and subsequently down the waste water drain, before they enter the shower.

In installations where there is a distance between the shower head and the domestic water heater, this wasted slug of water may represent a considerable loss, both financially and environmentally.

Many prior systems have been disclosed which propose to conserve domestic water, most particularly potable domestic water. Some such systems, (as exemplified by U.S. Pat. No. 4,197,597) essentially amount to in-house waste water reclamation and treatment facilities. Such systems are relatively complex; require a substantial capital investment; require specialty parts and fittings which are not commonly found in the market; are susceptible to plumbing backups; are not well suited for retrofit applications; require external (i.e. electrical) power supplies; and require continuous maintenance.

Many prior systems (as exemplified by U.S. Pat. Nos. 3,11,497; 3,594,825; 3,188,656; and 4,162,218) comprise water recirculation systems which accumulate waste or "grey" water (i.e. waste water from sinks, tubs, dishwashers, and the like) in supplemental tanks until needed, then use the recycled grey water to flush toilets. All of such prior water conservation systems dirty waste water. And, indeed, it is the dirty (and in some involve the storage (for potentially long periods of time) of case smelly) water that is used to flush the toilets. Not only does he use of this grey water dirty the toilet, but the long term storage of this grey water presents a potential health hazard.

Another problem of virtually all such prior water conservation systems is that they require a supplemental pump (and Corresponding supplemental power supply) to transport the waste water from its collection point (i.e. downstream of the sink or tub drain) to the toilet's water closet. Particularly limited systems (such as the gravity flow system disclosed in U.S. Pat. No. 3,594,825) have been proposed in which the toilet's water closet is at a substantially lower elevation than the collection point (i.e. the sink or tub drain). Such systems are of exceptionally narrow application, and are not suited for retrofit use, and, again, depend on the use and storage of grey water.

OBJECTS

Accordingly, it is a primary object of the present invention to provide water conservation system in which cooled-down water in a pressurized "hot water" pipe line is diverted for storage or directly to the toilet water closet or is blended with available hot water and no storage used.

It is another object of the present invention to provide a device of the character described in which the temperature or volume of the water in a "hot water" pipe line is manually or automatically sensed or restricted so that the cold and/or hot water will be respectively blended or diverted toward either a storage area or to the toilet's water closet or through a shower head or faucet when a manual valve is opened.

It is another object of the present invention to provide a device of the character described in which the water which is blended is diverted to the water closet or other fixture is clean.

It is another object of this invention to provide a system to reuse or blend water normally wasted in the course of events occurring during normal faucet and spigot operation which provide hot water.

It is another object of the present invention to provide a device of the character described which can be constructed using commonly available plumbing, fittings, and/or specifically constructed components or arrangements of said fittings, or when introductory water is blended at the supplied tube of the fixture.

It is another object of the present invention to provide a device of the character described which is readily adapted for retrofit applications on existing domestic water systems, and standard piping installations.

It is another object of the present invention to provide a device of the character described in which the diverted or purged "cooled down" water is used to supplement the primary (i.e. direct) water closet water supply or other use requiring clean water.

It is another object of the present invention to provide a device of the character described which addresses limited minor voltages for various valving configurations, which voltages are self generating from heat or external from DC supplies such as those found in household batteries or converter rectifiers and only for human convenience and is collateral to operation, the limited use of which is of economic comparison It is another object of the present invention to provide a device of the character described which is easily maintained and conforms to generally existing common plumbing codes and practices.

It is another object of this invention to provide a manual purge arrangement to discharge unheated water into a receiver for use in the water closet or other use requiring clean water.

It is another object of this invention to provide a manual throttle valve or orifice at the hot water line serving the fixture and adding a second smaller independent tube running from the hot water source to the fixture in order to bled the hot water and cold water in the pipe at the fixture.

Further objects and advantages of my invention will become apparent from a consideration of the drawings and ensuing description thereof.

DRAWINGS

Figure 13:
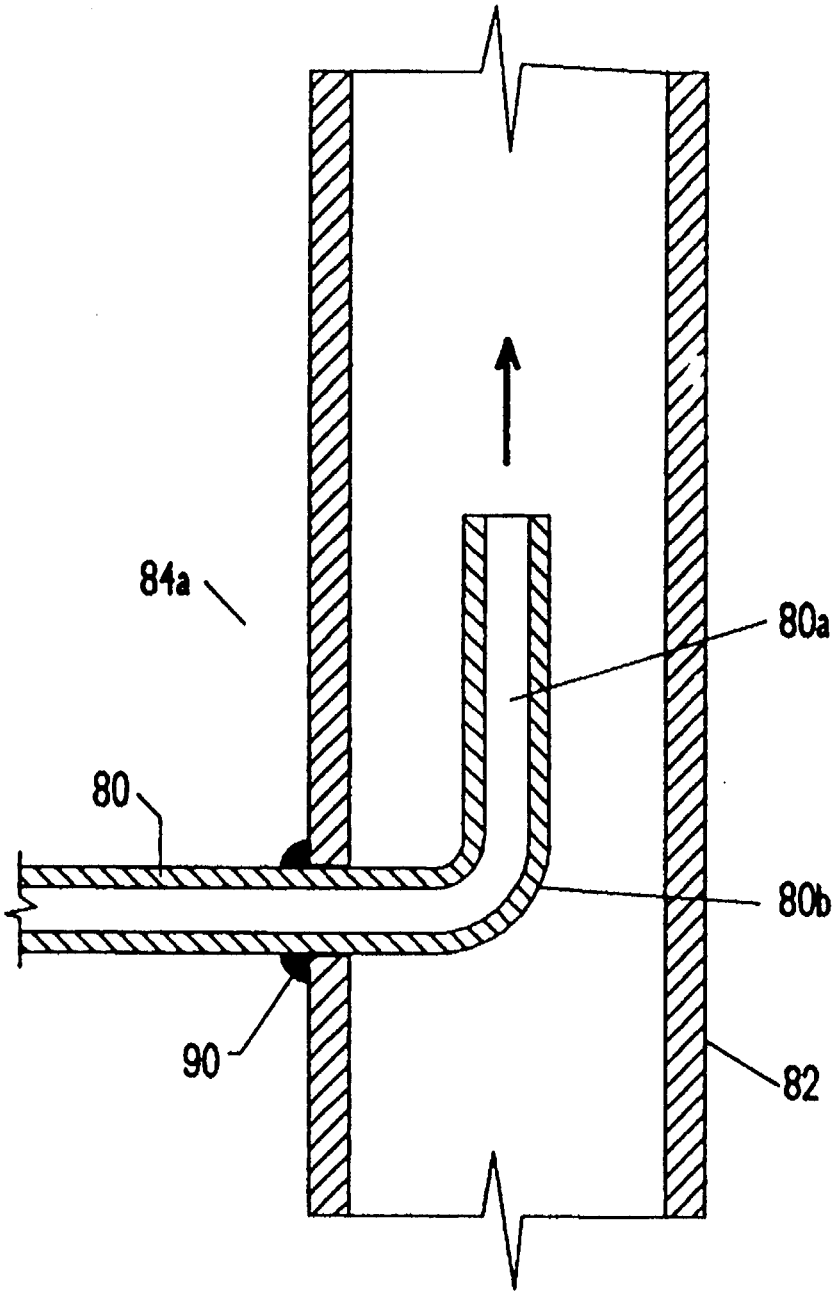

and FIG. 13 is a medial cross-sectional view showing the details of construction of a co-axial pipe and tube member used in a modification of the present invention.

DESCRIPTION

Figure 1:
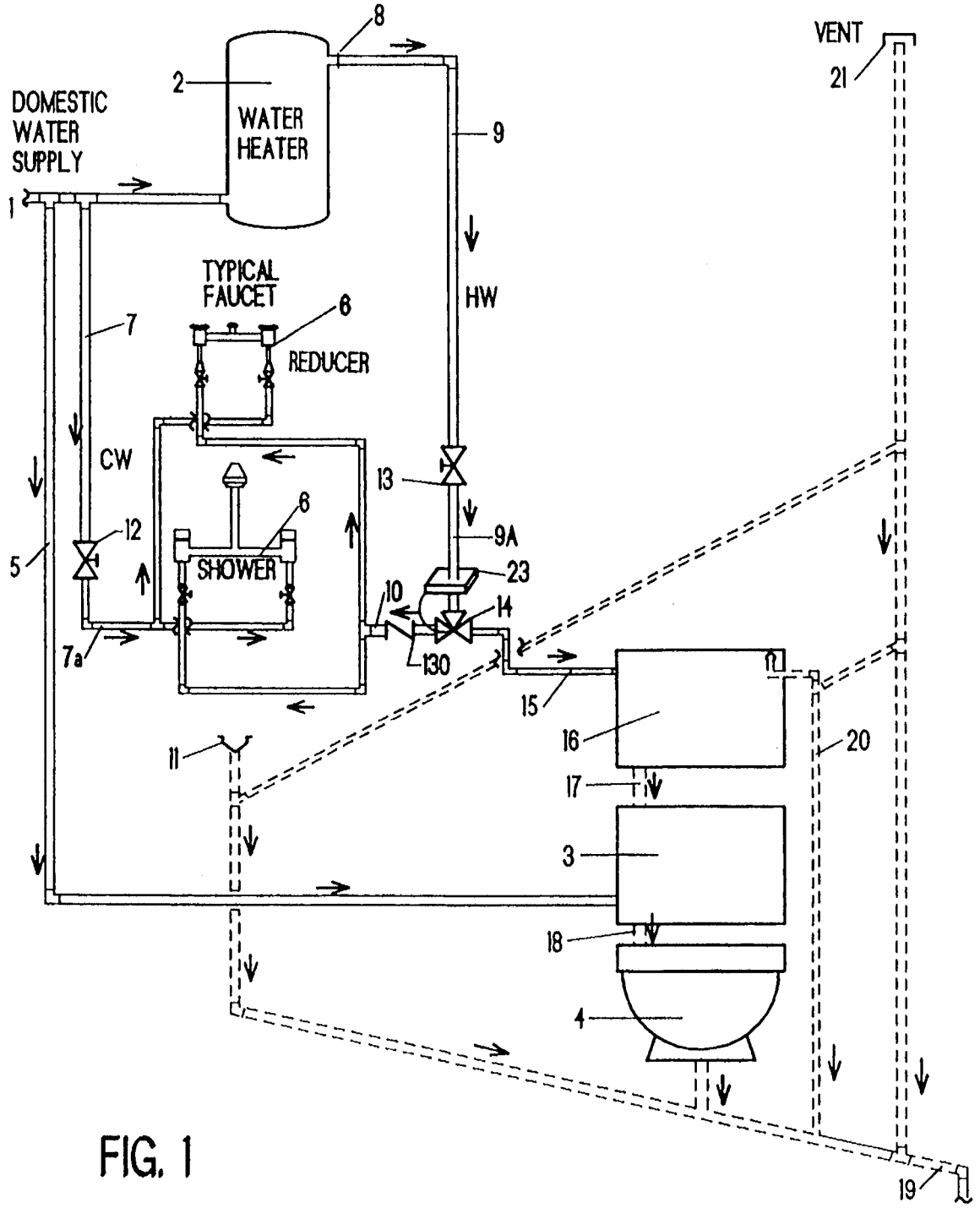
FIG. 1 is a schematic view showing the plumbing system of the present invention.

Referring first to FIG. 1, in the preferred embodiment of the water conservation System of the present invention a pressurized domestic water supply line 1 is connected to a water heater 2. The domestic water supply line 1 is also connected (via pipe line 5) to primary water closet 3, and to a shower head 7 (via cold water pipe line 7 and 7*a*).

Water under pressure is heated by the water heater 2. The discharge side 8 of the water heater is connected (via hot water pipe line 9, 9*a* and 10) to the shower head 6. A manual "cold water" valve 12 regulates the flow of cold water through pipe line 7 and 7*a* to the shower head. Water released through the shower head 6 goes down the shower drain 11.

A manual "hot water" valve 13 which is in series with the shower head 6 and the water heater 2 regulates the flow of water through the hot water pipe line 9 and 9*a*.

Figure 2:
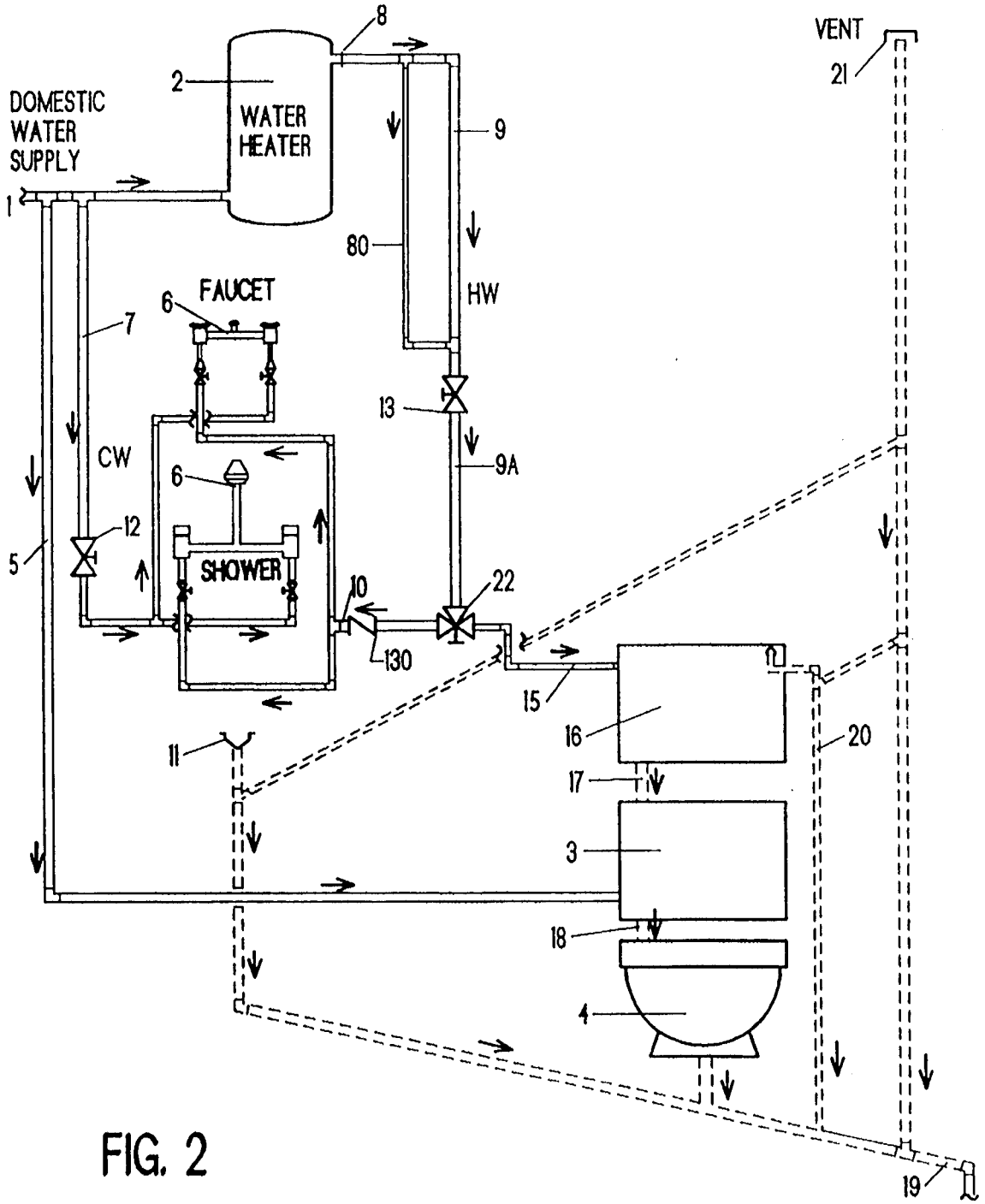
FIG. 2 is a schematic view similar to FIG. 1, but showing a modification of the present invention having a manually controlled diverter valve.

A thermostatically controlled diverter valve 14 is in series with the manual "hot water" valve 13 and the shower head 6. The thermostatically controlled diverter valve 14 is in communication with a temperature sensor 23 which preferably senses the temperature of the water inside of pipe line 9*a*. The temperature sensor 23 is schematically represented in FIGS. 1 and 2 as being remote to (albeit in communication with) the diverter valve 14. As will be discussed in further detail below, the sensor may, in practice, be constructed remotely or as an intrinsic component of the diverter valve 14. Pressurized water enters the thermostatically controlled diverter valve 14 via pipe line 9*a*, and exits therefrom via either pipe line 10 or pipe line 15, depending upon the temperature of the water which is sensed by the sensor 23.

Pipe line 15 is connected to a secondary water closet 16 which is located at an elevation above the primary water closet 3. Primary water closet 3 and secondary water closet 16 are each open vessel-type (i.e. non-pressurized) holding tanks. The secondary water closet 16 is connected to the primary water closet 3 by discharge pipe line 17 which allows for gravity flow of water from the inside of the secondary water closet 16 to the primary water closet 3. An overflow pipe line 20 is connected from the secondary water closet 16 to the building's waste drain line 19. A discharge pipe line 18 between the primary water closet 3 and the toilet bowl 4 allows for gravity flow (i.e. flushing) of water from inside of the primary water closet 3 to the toilet bowl 4. The toilet bowl 4 is connected to the building's waste drain line 19. The waste drain line 19 is vented 21 to the atmosphere.

A modification of the water conservation system of the present invention is shown in 2. In this modification of the invention, a manual diverter valve 22 is n series with the manual hot water valve 13 and pipe lines 10 and 15 (in place of the thermostatically controlled diverter valve 14 which is used in the preferred embodiment of the invention).

Figure 3:
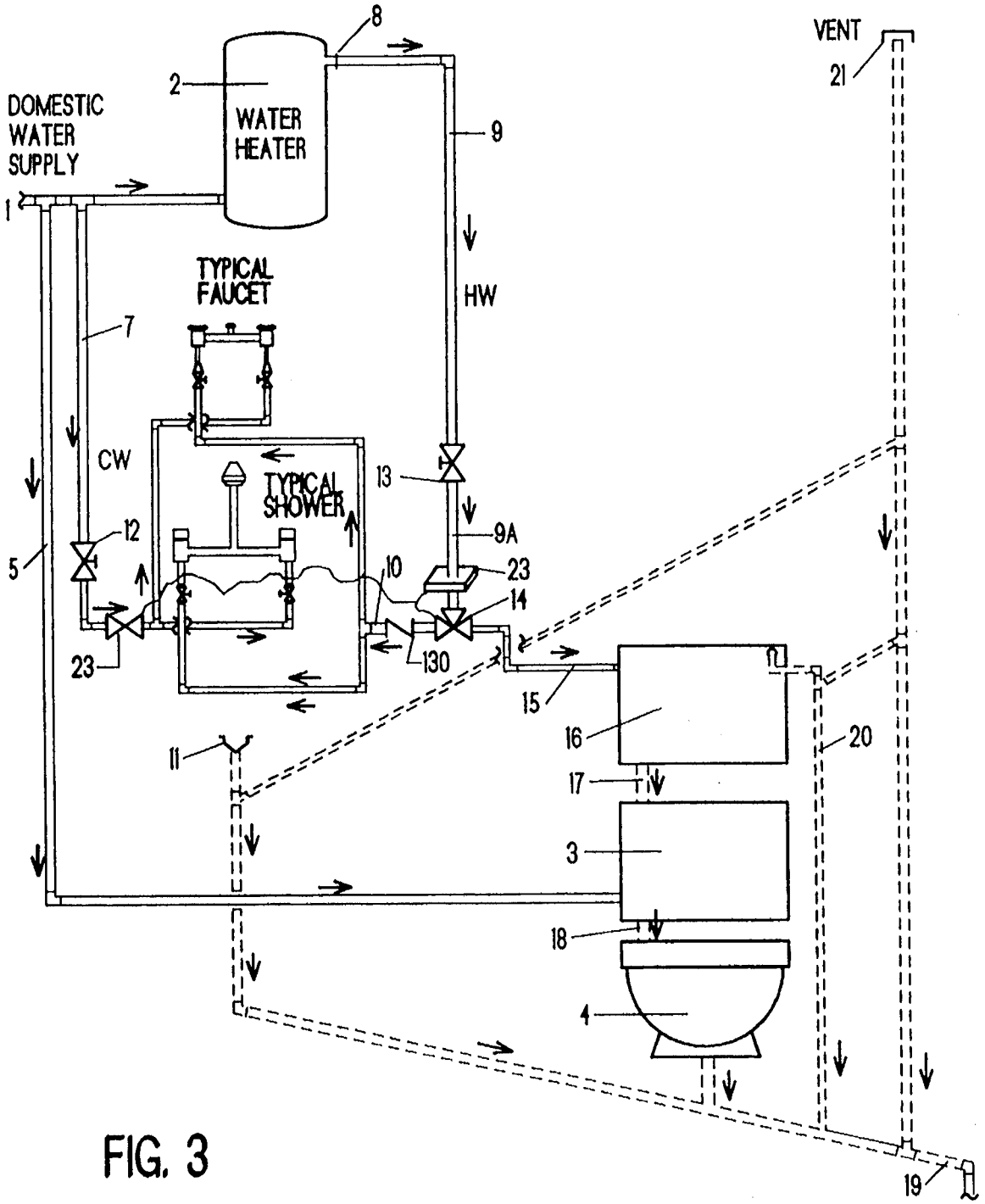
FIG. 3 is a schematic view similar to FIG. 1, but showing a modification of the present invention having a thermostatically controlled cold water lock-out valve.
Figure 4:
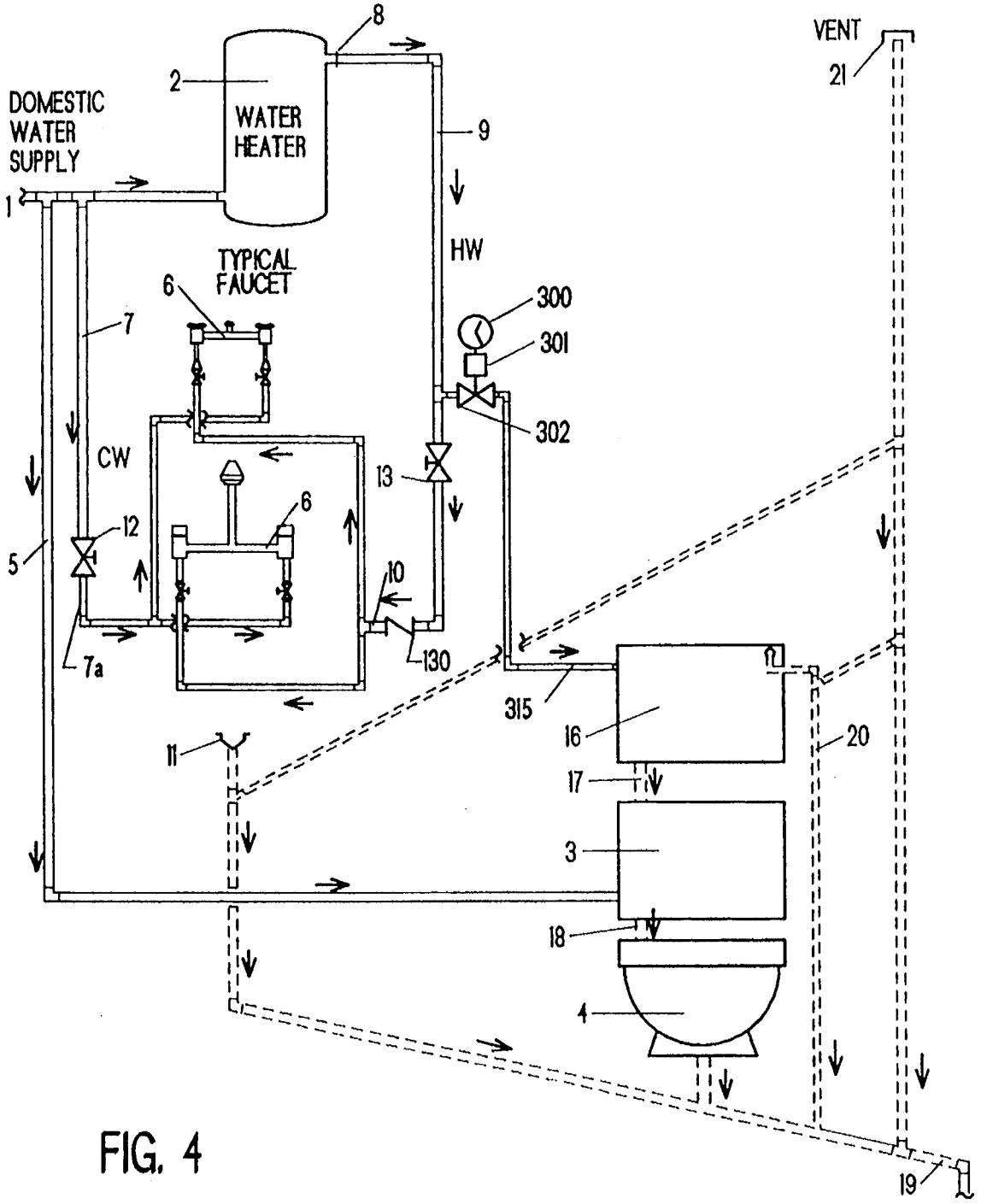
FIG. 4 is a cross-sectional elevation view showing in detail the construction of the primary and secondary water closets of the preferred embodiment of the present invention.

Another modification of the water conservation system of the present invention is shown in FIG. 3. In this modification of the invention there is additionally a thermostatically controlled cold water lock-out valve 23 located in the cold water pipe line 7*a*, between the manual cold water valve 12 and the shower head 6. The thermostatically controlled cold water lock-out valve 23 is in communication with the water temperature sensor 23. When the water temperature sensor 23, senses low temperature water in the "hot water" pipe line 9*a*, it signals the thermostatically controlled diverter valve 14 to close off the hot water supply line 10 to the shower head 6 and open the pipe line 16 leading into the secondary water closet 16, and additionally closes the thermostatically controlled cold water lock-out valve 23 in the cold water shower supply pipe line 7*a*. When the water temperature sensor 23 senses high temperature water in the "hot water" pipe line 9*a*, it signals the thermostatically controlled diverter valve 14 to close off the pipe line 16 leading into the secondary water closet 16 and opens the pipe line 10 leading to the shower head and additionally opens the thermostatically controlled cold water lock-out valve 23 in the cold water shower Supply pipe line 7*a*.

Figure 8:
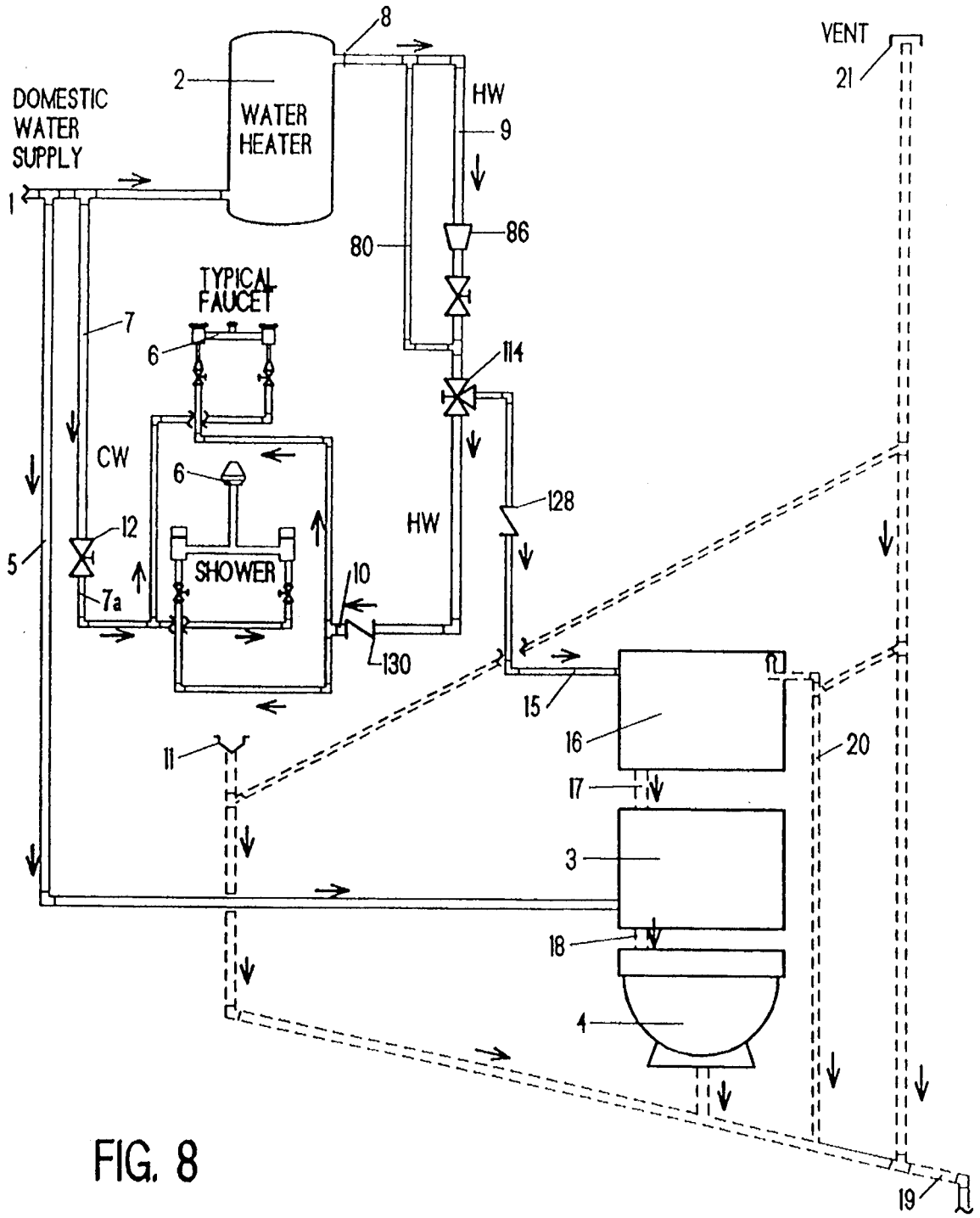
FIG. 8 is a schematic view similar to FIG. 1, but showing a modification of the present invention having a manually closeable, thermostatically controlled diverter valve.

FIG. 8 shows a modification of the water conservation System of the present invention using a single manually closeable, thermostatically controlled, diverter valve 114 which has a built-in bimetallic temperature sensor 123. As shown in FIG. 8, a check valve 128 may be provided in the pipe line 15 leading from the diverter valve 114 to the secondary water closet 10, to prevent back flow of water from the secondary water closet 16. This configuration, as well as those illustrated in other figures, can also incorporate the hot water shunt tube 80, which will be discussed in more detail below.

Figure 9:
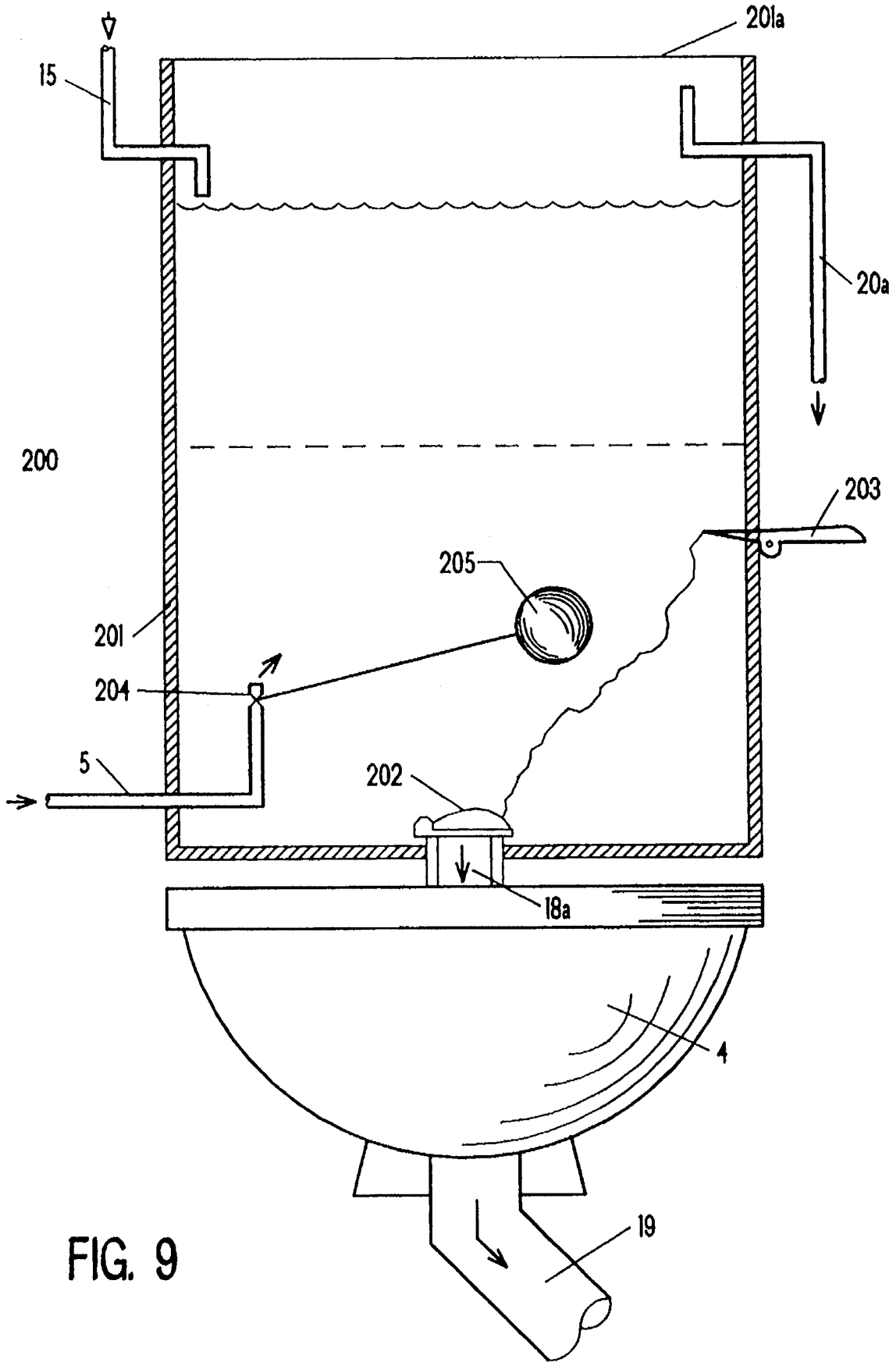
FIG. 9 is a medial elevation showing the construction of an extended water closet as used in the modification of the invention shown in FIG. 10.

FIG. 9 shows a modification of the invention in which no diverter tanks are used, but a second hot water line (i.e. hot water shunt tube 80) is added.

Figure 5:
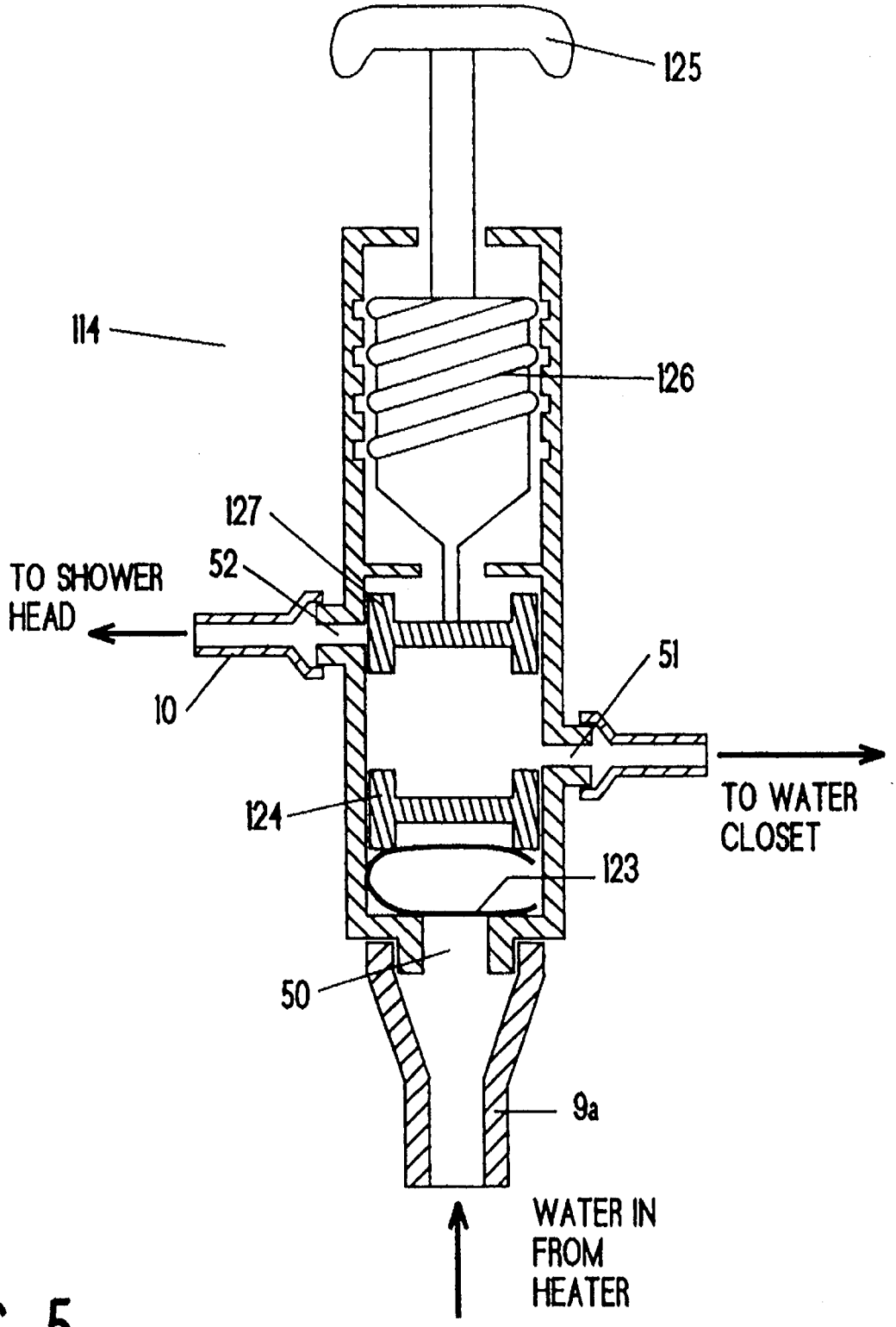
FIGS. 5–7 are al cross-sectional views showing the construction and operation of the thermostatically controlled diverter valve of the preferred embodiment of the invention.
Figure 6:
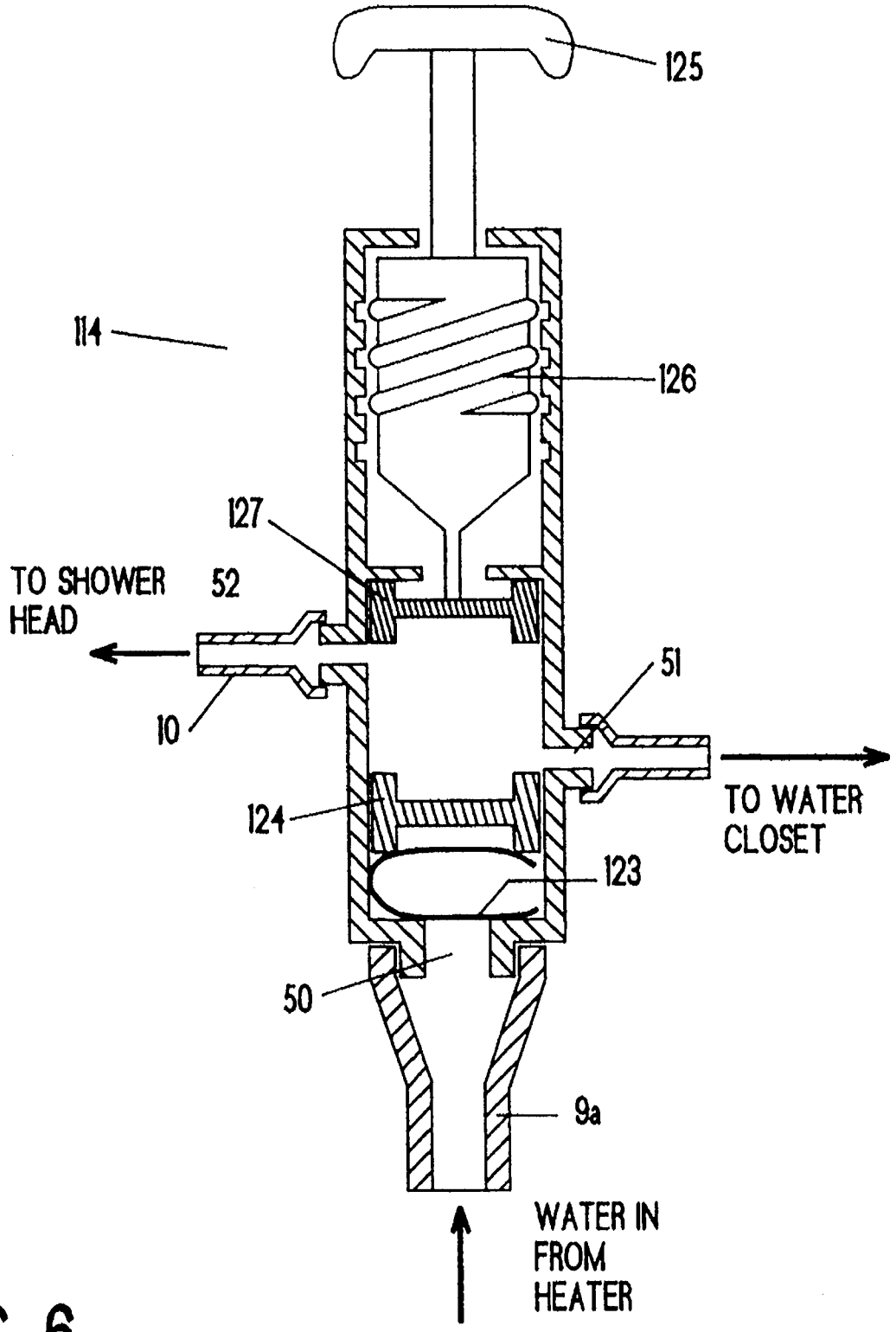
Figure 7:
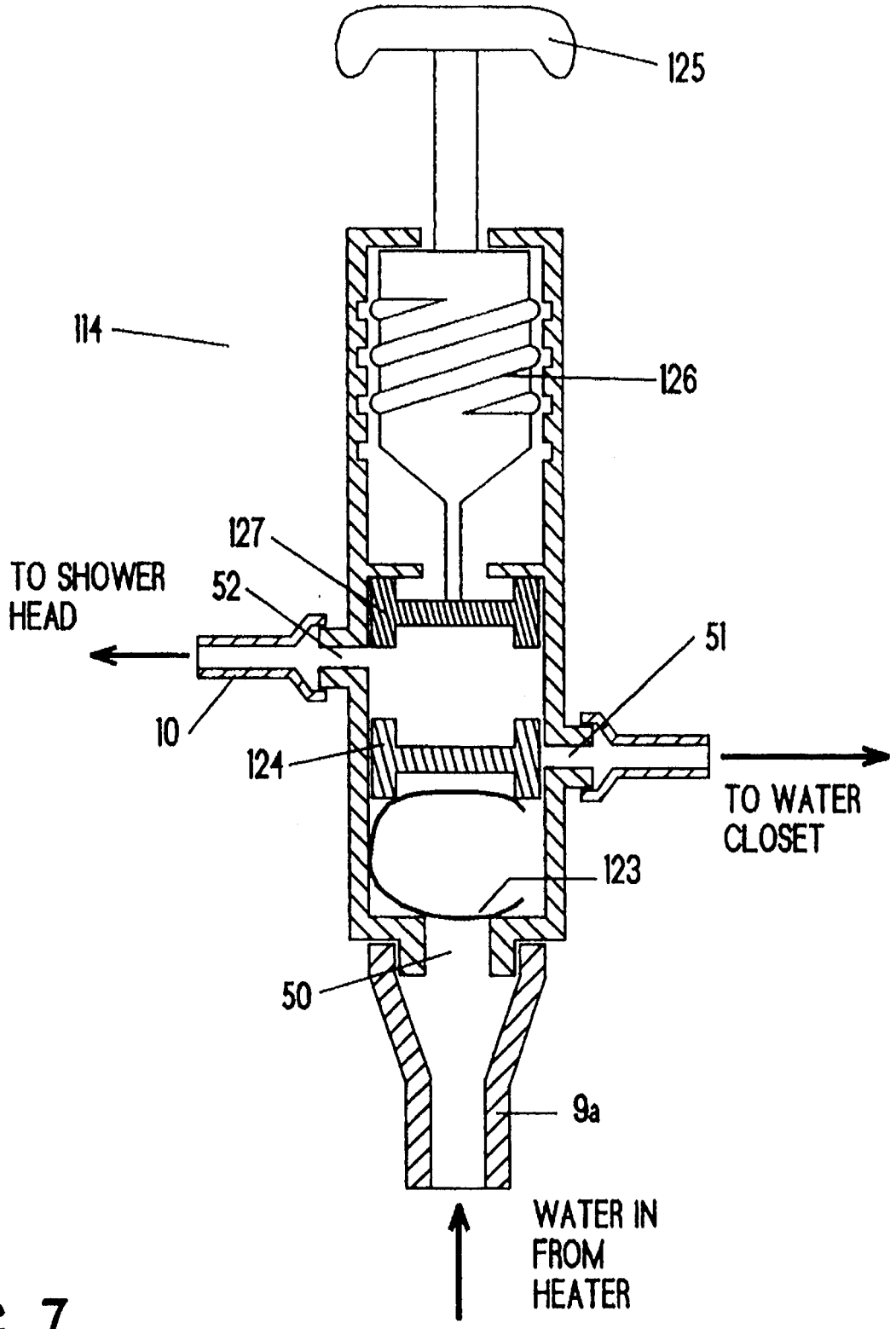

FIGS. 5–7 show the details of construction of a the manually closeable thermostatically controlled, diverter valve 114. The manually closeable, thermostatically controlled, diverter valve 114 has a water inlet orifice 50, which, in operation is attached to the pipe line 9 which leads from the water heater 2; a cool water outlet orifice 51, which, in operation, is attached to the pipe line 15 which leads to the secondary water closet 16; and a hot water orifice 52, which, in operation is connected to the hot water pipe line 10 which leads to the shower head 6. The temperature sensitive bimetallic sensor 123 is attached to an axially moveable annular valve seat 124. When heated to a pre-selected high temperature the bimetallic sensor 123 expands, pushing the annular valve seat to close the cool water outlet orifice 51 (as illustrated in FIG. 7). At lower temperatures the bimetallic sensor 123 contracts, pulling the annular valve seat away from (and thus opening) the cool water outlet orifice 51 (as illustrated in FIG. 5). A handle 125 connected to a threaded stem 126 and a second axially moveable annular valve seat 127. When the handle 125 is turned in one direction the threaded stem 126 pushes the second annular valve seat, closing it against the hot water outlet orifice 52 (as illustrated in FIGS. 5. When the handle 125 is turned in the opposite direction the threaded stem 126 pulls the second annular valve seat, thus opening the hot water outlet orifice 52 (as illustrated in FIGS. 6 and 7).

Figure 12:
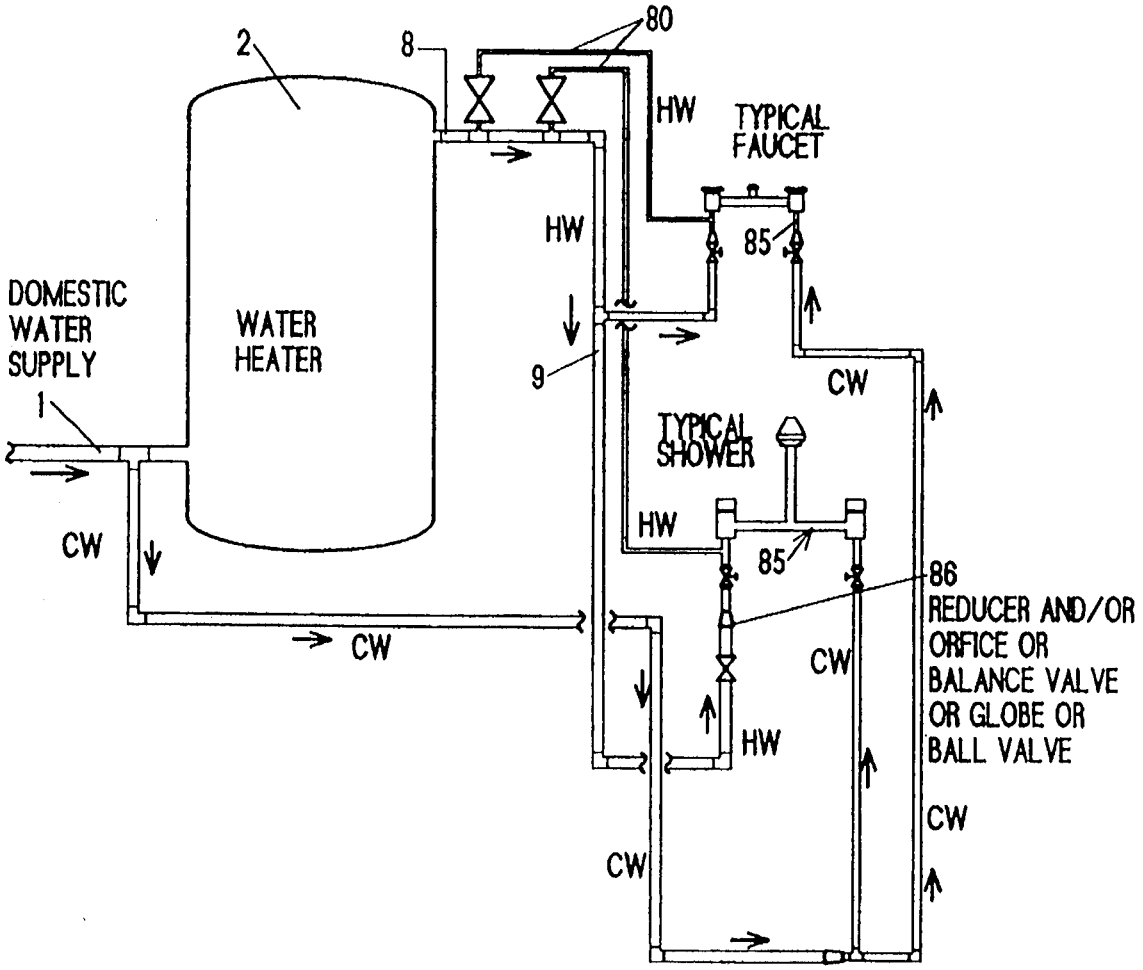
FIG. 12 is a is a schematic view similar showing a modification of the present invention.

FIG. 12 illustrates a modification of the invention in which a hot water shunt tube 80 connected to the discharge side 8 of the water heater 2 runs parallel to the hot water pipe 9. The hot water pipe 9 and the hot water shunt tube 80 intersect at fitting 84. The fitting 84 is also connected to hot water faucet supply tube 82. The hot water faucet supply tube 82 is connected to hot water faucet 83 in sink 85. In this modification of the invention, the hot water pipe 9 is preferably ½" or ¾" pipe; and the hot water shunt tube 80 is preferably ¼" nor ⅛" tubing; and the hot water faucet supply tube 82 is preferably ¼" or ⅜" tubing. A reducer fitting 86 may be provided in the hot water pipe 9 to accommodate the change in diameter from the hot water pipe 9 to the hot water faucet supply tube 82. Alternatively, fitting 84 may be a modified reducer tee having (1) ½" or ¾" orifice to accommodate the hot water pipe 9; and (2) a ¼" nor ⅛" orifice to accommodate the hot water shunt tube 80; and (3) a ¼" or ⅜" orifice to accommodate the hot water faucet supply tube 82.

The hot water shunt tube 80 modification of the invention which is illustrated in FIG. 12, is similarly adaptable for use with each of the other embodiments of the inventions discussed herein and illustrated in the figures. The hot water shunt tube 80 modification of the invention is also illustrated in FIG. 8.

OPERATION

Referring now to FIG. 1: When a person wishes to use a fixture or shower, the manual hot water valve 13 is opened. Water which is under pressure from the domestic water supply 1 enters the bottom of the water heater 2. The incoming water pushes hot water out of the top of the water heater 2 through the water heater discharge 8. This, in turn, causes the slug of water which is initially occupying the volume inside of the pipe line 9 between the water heater discharge 8 and the manual hot water valve 13 to begin moving past the thermal sensor 23 and through the thermostatically controlled diverter valve 14. In, the event that the slug of water that was initially occupying the volume inside of pipe line 9 has cooled below a pre-selected temperature or cannot be blended to achieve a given temperature for example below 110 degrees Fahrenheit, (as may typically occur when a stagnant slug of water is allowed to remain inside of the pipe line 9 for long periods of time), the thermal sensor 23 will cause the thermostatically controlled diverter valve 14 to close off flow in the direction of the shower head (i.e. via pipe line 10) and simultaneously open flow in the direction of the secondary water closet 16 (i.e. via pipe line 15).

Water under pressure enters the secondary water closet via pipe line 15, thus filling the secondary water closet 16. If the secondary water closet 16 is already full of water, (or becomes full of water), the water in the secondary water closet 16 will simply pass into the overflow pipe line 20, and pass to the waste drain line 19. The secondary water closet 16 is an "open vessel", thus the water inside of the secondary water closet 16 is not under pressure. In the preferred embodiment of the invention, the water inside of the secondary water closet is used to supplement the water supply to the primary water closet 3. The operation of the primary and secondary water closets are described in detail below. It will be appreciated, however, that the water that is diverted to the secondary water closet 16 could alternatively be diverted to any "open vessel" potable water holding tank; and the water thus stored could subsequently be used on demand for many purposes.

As noted above, when the slug of water that is initially in pipe line 9 (between the water heater 2 and the manual hot water valve 13) is below a pre-selected temperature, the thermostatically controlled diverter valve 14 closes of water to the shower head 6 via pipe line 10. As the slug of water that is initially in pipe line 9 passes the manual hot water valve 13, the temperature of the water in the pipe line 9, and in particular the water passing in the vicinity of the temperature sensor 23, increases. When the temperature of the water passing the sensor 23 is at or above a pre-selected level, the sensor 23 causes the thermostatically controlled diverter valve 14 to automatically close off flow to the secondary water closet 16 (via pipe line 15), and automatically open flow to the shower head 6 (via pipe line 10).

It will be appreciated that a system constructed in accordance with the above described preferred embodiment of the invention (as shown in FIG. 1) will allow only heated water (that is, water at or above a pre-selected temperature) to flow to the shower head 6 or other fixture from the hot water pipe line 9.

It will also be appreciated that a system constructed in accordance with the above described preferred embodiment of the invention (as shown in FIG. 1) conserves the "cooled down" slug of stagnant water in the "hot water" pipe line 9 by diverting it to secondary water closet 16 or blending it with injected hot water originating at the how water source.

When the person is finished taking a shower, the manual hot water valve 13 may be closed, thus stopping flow of water through the hot water pipe line 9 to the diverter valve 14.

It will be appreciated by those skilled in the art that, in a system constructed in accordance with the preferred embodiment of the invention (as shown in FIG. 1), the manual cold water valve 12 may at any time be opened as desired to regulate the flow of cold water into and through the shower head 6. A modification of the present invention, however, is illustrated in FIG. 3 in which the temperature sensor 23 is additionally in communication with a cold water lock-out valve 23 in the cold water pipe line 7*a*. In this modification of invention when the temperature sensor detects low temperature water in the hot water pipe line 9*a*, it causes the thermostatically controlled cold water lock-out valve 23 concurrently with the closing off of the pipe, line 15 to the secondary water closet 16. In operation, using this modification of the system, both the manual cold water valve 12 and the manual hot water valve 13 may be turned on (i.e. opened) when a person is ready to take a shower; but no water will begin to flow from the shower head 6 until the temperature sensor 23 detects sufficiently high temperature water in the hot water pipe line 9*a*.

Another modification of the invention is illustrated in FIG. 2. In this modification of the present invention, a manual diverter valve 22 replaces the thermostatically controlled diverter valve 14 used in the preferred embodiment of the invention. This modification of the invention may be advantageously used in applications wherein the distance between the water heater 2 and the shower head 6 (and the corresponding volume of stagnant water which may be captured in the hot water pipe line 9) is relatively small. In such instances, prior to taking a shower, a person can simply turn the manual diverter valve 22 for a short time, so that it diverts a relatively small quantity of water from the hot water pipe line 9 towards the secondary water closet 16 (via pipe line 15). Then the manual diverter valve 22 is simply turned back so as to divert flow to the shower head via pipe line 10.

An important modification of the present invention is illustrated in FIG. 8. In this embodiment of the invention a manually closeable, thermostatically controlled, diverter valve 114 is installed into the hot water pipe line 9. The preferred embodiment of the manually closeable, thermostatically controlled, diverter valve 114 is illustrated in more detail in FIGS. 5–7. In this embodiment of the water conservation system of the present invention, in order to turn "on" the hot water to the shower head 6, is only necessary to manually turn the handle 125 to the manually closeable, thermostatically controlled, (MCTC) diverter valve 114. As discussed above, when the water entering the MCTC diverter valve 114 is below a preselected temperature, the bimetallic sensor 123 compresses and allows the low temperature water to flow to the secondary water closet (via pipe line 15). When the water entering the MCTC diverter valve 114 is sufficiently hot, the bimetallic sensor closes off flow to the secondary water closet (via pipe line 15) and diverts flow instead to the shower head 6 (via pipe line 10).

It will be appreciated by those skilled in the art that the water conservation system constructed in accordance with the modification of the invention illustrated in FIG. 8, provides for the diversion of clean water, under pressure, to a secondary water closet 16, without the use of supplemental power sources, and in particular does not require the use of supplemental pumps, nor electrically powered sensors. It will also be appreciated by those skilled in the art that the water conservation system constructed in accordance with the modification of the invention illustrated in FIG. 8 is well suited for retrofit applications, and, with the exception of the MCTC diverter valve 114 can be constructed using coon plumbing fixtures and supplies.

Figure 10:
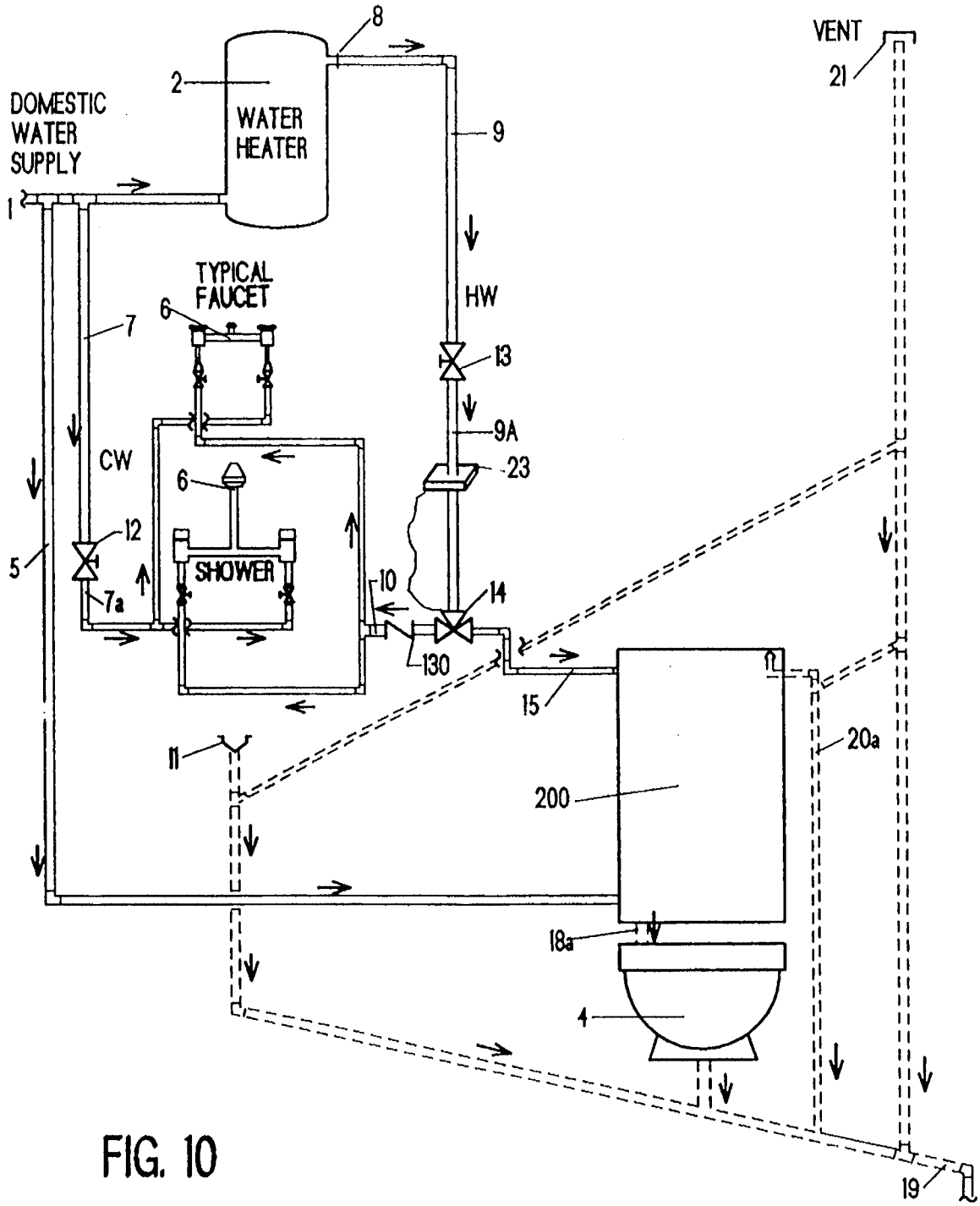
FIG. 10 is a schematic view similar to FIG. 1, but showing a modification of the invention having a single, extended water closet.

FIGS. 9 and 10 illustrate a modification of the present invention in which the diverted water is connected via pipe line 15 to a modified water close 200. As illustrated in FIG. 9, the modified water closet 200 comprises an extended open vessel 201 which has a volumetric capacity in excess of the volume (of water) which is necessary to complete on flushing cycle of he toilet bowl 4. As with common water closets, the bottom of the open vessel 201 is connected to the toilet bowl by conduit 18*a*, which has a flapper valve 202 connected to a manual handle 203. As with common water closets, domestic water under pressure may enter the vessel 201 via pipe line 5, which has a ball cock valve 204 that is connected to a float 205. Water may only enter the vessel 201 via pipe line 5 when the level of the water inside of the vessel is below the elevation of the float 205; whenever the water level inside of the vessel 201 is above the float 205 the ball cock valve 204 will remain closed and flow into the vessel via pipe line 5 will be prohibited. As illustrated in FIG. 9, the top 201*a* of the vessel is at a significantly higher elevation than the maximum elevation of the float 205. Preferably, the volumetric capacity of the vessel 201 above the maximum elevation of the float is at least as great as the volumetric capacity of the vessel 201 below the maximum elevation of the float 205. Water diverted from the shower head via pipe line 15 enters the upper end of the vessel 201, thus providing make-up water to the modified water closet 200. When the vessel 201 is full of water, additional water diverted to the modified water closet 200 will over flow to the over flow pipe line 20*a* which is connected to the waste drain 19.

FIG. 12 illustrates how, when a second line (i.e. a hot water shunt tube 80) is used in conjunction with or without some of the components mentioned in FIGS. 1 through 10, the water is delivered to the fixture through both the hot water supply piping and the shunt tube simultaneously and is mixed at the appliance or fixture, thus tempering the hot water discharged by the appliance or fixture.

More Particularly, FIG. 12 illustrates a modification of the invention in which a hot water shunt tube 80 connected to the discharge side 8 of the water heater 2 runs parallel to the hot water pipe 9. In this modification of the invention, the hot water pipe 9 is preferably ½" or ¾" pipe; and the hot water shunt tube 80 is preferably ¼" nor ⅛" tubing; and the hot water faucet supply tube 82 is Preferably ¼" or ⅜" tubing. The length of the hot water shunt tube 80 is Preferably no greater than the length of the hot water pipe 9. It will be appreciated by those skilled in the art that because the inside diameter of the hot water shunt tube 80 is smaller than the inside diameter of the hot water pipe line 9, the volume of the slug of water inside of the hot water pipe line 9 will be greater at any given instant than the slug of water inside of the hot water shunt tube 80. It will also be understood that because both the hot water shunt tube 80 and the hot water piping 9 are connected to the discharge side of the water heater 2, the hot water shunt tube 80 and the hot water piping 9 are under the same pressure. However, because both the hot water shunt tube 80 and the hot water piping 9 a discharge (either directly or indirectly) into the hot water faucet supply tube 82, the water which flows through the hot water piping 9 encounters a constriction (for example at reducer fitting 86, or at fitting 84, or otherwise) immediately upstream of the hot water faucet supply tube 82. Therefore, owing in part to this constriction encountered by water flowing from the hot water piping 9 to the hot water faucet supply tube 82) an initial slug of (for example, relatively cool) water inside the hot water shunt tube 80 will be purged (i.e. discharged through the hot water faucet 83) more quickly than will an initial slug of (for example, relatively cool) water inside of the hot water piping 9.

As soon as the initial slug of (for example, relatively cool) water is purged from the hot water shunt tube 80, hot water will thereafter flow through it. Thus it will be understood that hot water will initially be shunted from the water heater 2 to the hot water faucet supply tube 82 more quickly than will hot water that flows through the hot water pipe line 9. Because water will continue to flow through both the hot water shunt tube 80 and the hot water piping 9 into the hot water faucet supply tube 82, the water temperature inside of the hot water faucet supply tube 82 will be at a weighted average of the mixed water supplied thereto from the hot water shunt tube 80 and the hot water piping 9.

It will be understood that the described modification comprising a hot water shunt tube 80 provides a means for more quickly heating up water that is being discharged from the hot water faucet 83 than would be available with hot water piping 9 alone (i.e. without such a hot water shunt tube 80). I will also be understood that because of how quickly the water discharged through the faucet 83 water becomes heated, there may be less (cold) water wasted down the drain while waiting for the water at the faucet to heat up.

It will be appreciated by those skilled in the art that the reason the (smaller diameter) hot water shunt tube 80 is purged more quickly than the (bigger diameter) hot water piping 9 is because of the relatively greater flow restriction encountered by water from the hot water piping 9 than by the water from the hot water shunt tube 80 as each is discharged into the hot water 15 faucet supply tube 82. The disparity between the flow restriction encountered by water discharged from the hot water shunt tube 80 and the hot water piping 9 may be enhanced by providing a reducer fitting 86 downstream of the hot water piping 9.

The disparity between the flow restriction encountered by water discharged from the hot water shunt tube 80 and the hot water piping 9 may also be enhanced by reducing the pressure drop at the point of intersection of the hot water shunt tube 80 and the hot water piping 9, or, alternatively, the point of intersection of the hot water shunt tube 80 and the hot water faucet supply tube 82. FIG. 13 illustrates a fitting **84*a* which reduces the pressure drop at the point of intersection between the hot water shunt tube 80 and the hot water faucet supply tube 82. In this fitting 84, the hot water shunt tube 80 intersects the wall of the hot water faucet supply tube 82 and turns, via full radius elbow 80*b*, and has an axially aligned discharge 80*a* which is substantially coaxial with the hot water faucet supply the 82. Silver solder 90, or similar means may be used to ensure a water tight joint between the hot water shunt tube 80 and the hot water faucet supply tube 82**

It will be appreciated by those skilled in the art that in most common domestic water systems a single water heater may be used to supply various fixtures. For example a single water heater may typically supply hot water to a bathroom sink, a bath tub faucet, a bathroom shower, and a kitchen sink. In such systems the various fixtures may be fed by a single common trunk hot water pipe, typically. When such trunk hot water pipe lines feed bathroom or kitchen sink faucets, the tubing connections at the faucets are typically of smaller diameter than the trunk pipe. As discussed in the example above with reference to FIG. 12 the hot water pipe is preferably ½" or ¾" pipe, and the hot water faucet supply tube 82 is preferably ¼" or ⅜" tubing As discussed above this reduction in pipe/tube dimension results in a flow restriction which is taken advantage of in the present invention by the hot water shunt tube 80. However, in installations such as bath tube faucets and shower heads, where there is not typically a reduction in pipe/tube diameter between the trunk line and the fixture, it may be desirable to install an orifice plate (schematically indicated as 91 in FIG. 2) inside the fixture supply line 10 in order to introduce a flow control mechanism which would enhance the disparity between the flow restriction encountered by water discharged from the hot water shunt tube 80 and the hot water piping **9*a***.

Operation of Primary and Secondary Water Closets

Figure 11:
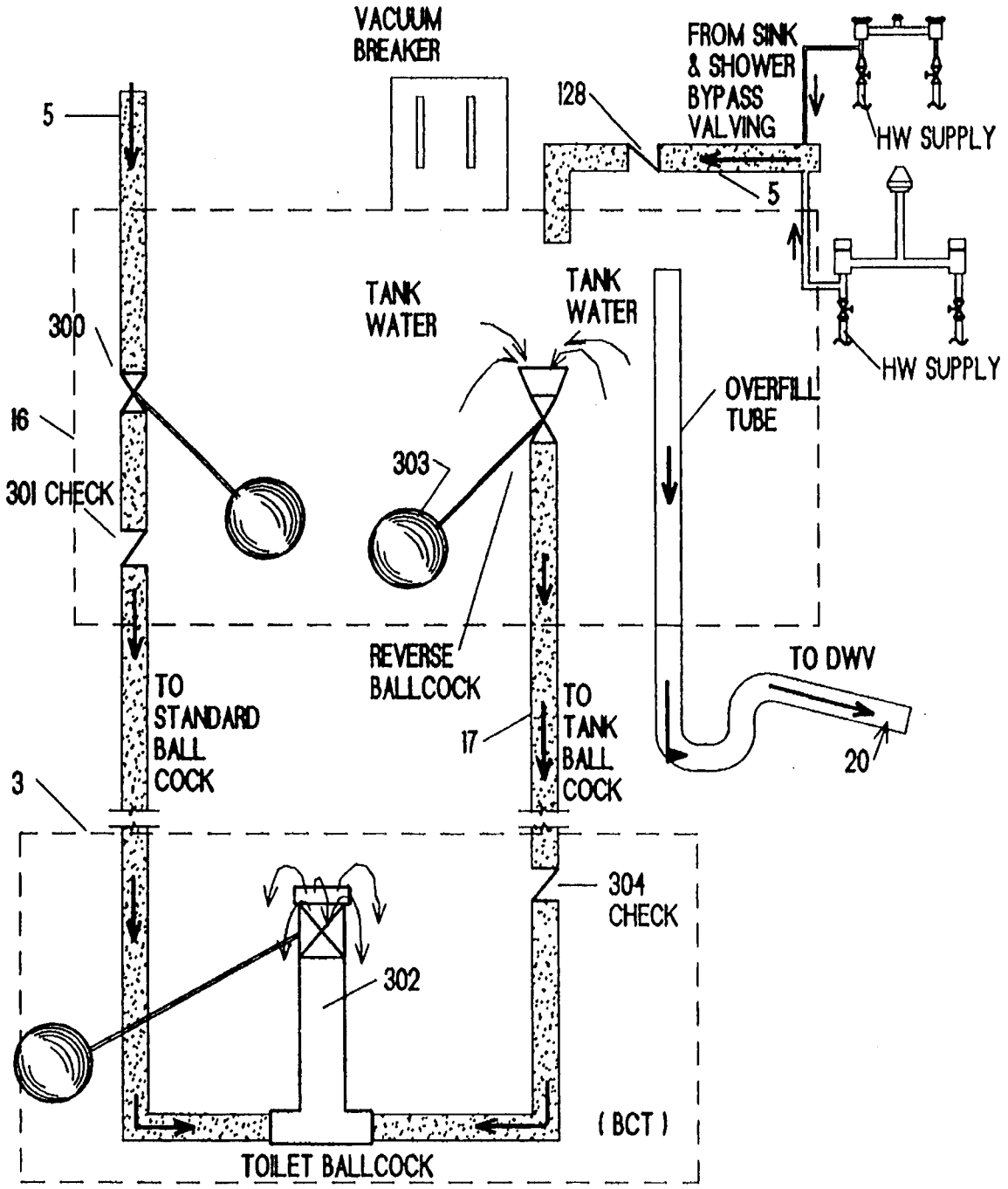
FIG. 11 is a medial elevation showing the construction of a dual-water closet embodiment of the present invention.

FIG. 11 illustrates the operation of the water conservation system of the present invention with a toilet having a primary 3 and secondary 16 water closet. Pressurized cold water pipe line 5 passes through the secondary water closet 16 and enters the primary water closet 3. A positive-acting ball-float valve 300 disposed inside of the secondary water closet prevents water from flowing through pipe line 15 into the primary water closet when the secondary water closet 16 contains water. A check valve 301 is located between the positive-acting ball-float valve 300 and the primary water closet's toilet ballcock 302. When the primary water closet's ballcock 302 is open and the secondary water closet's positive-acting ball-float valve 300 is open, water may then flow into the primary water closet 3 from pipe line 5.

Diverted water from the shower bypass enters the secondary water closet 16 via pipe line 15. A check valve 128 is located in pipe line 15 as shown in FIG. 11. The secondary water closet 16 is connected to the primary water closet's toilet ballcock 302 by pipe line 17. When the primary water closet's toilet ballcock 302 is open and the secondary water closet's ball-float valve 300 is closed, water will be passed from the secondary water closet 16 to the primary water closet 3 on demand from the primary water closet. A check valve 304 prevents flow of water through pipe line 17 from the primary water closet 3 to the secondary water closet 16.

While the above description contains many specificities, these should not be construed as limitations on the scope of the invention, but rather as an exemplification of one preferred embodiment thereof. Many other variations are possible, for example:

The diverted low temperature water (i.e. pipe line 15) may be connected a common atmospheric pressure holding or make-up tank;

A check valve 130 or thermal break may be installed between the thermally controlled diverter valve 14 and the shower head 6 to prevent short cycling;

Manually closeable, thermostatically controlled, diverter valves of constructions different from the MCTC diverter valve 114 shown may be used, including MCTC diverter valves with external sensors, and MCTC diverter valves which comprise electrical sensors, and MCTC diverter valve that are solenoid actuated;

The blending valve or tube is used independently with the cross over on the primary and secondary system;

The diverted water may be used in other areas beside water closets;

Whenever the term "pipe" or "pipe line" or the like is used above, other common fluid transfer conduits could be employed in their place;

The primary water closet and the secondary closet may comprise a single vessel having two interior chambers; or, The primary/secondary system piping and components are not used at all, but the cross over tube is used independent with or without valves or orifices.

Accordingly, the scope of the invention should be determined not by the embodiment illustrated, but by the appended claims and their legal equivalents.

I claim:

1. In a pressurized potable water piping system, the improvement comprising:

a water heater having an inlet and an outlet, said inlet being in communication with a pressurized water supply;

a first piping conduit member having a first end and a second end;

said first piping conduit member being connected a its first end to said water heater outlet;

a second piping conduit member having a first end and a second end;

said first end of said second piping conduit member being connected to a water discharge fixture;

and wherein said second piping conduit member is in fluid communication with said first piping conduit member such that said second end of said first piping conduit member and said second end of said second conduit member are disposed between said first end of said first conduit piping member and said first end of said second piping member; and further comprising a third piping conduit member having a first end and a second end;

and wherein said third piping conduit member is in fluid communication with said water heater outlet and said second piping conduit member such that said second end of said third piping conduit member and said second end of said second piping conduit member are disposed between said water heater outlet and said water discharge fixture;

and Wherein said first piping conduit member has a first inside diameter, and said second piping conduit member has a second inside diameter, and said third piping conduit member has a third diameter;

and wherein said first diameter is larger than said second diameter;

and said first diameter is larger than said third diameter.

2. The invention according to claim 1 further comprising:

a flow reduction fitting disposed between said second end of said first piping conduit member and said second end of said second piping conduit member.

3. The invention according to claim 2, further comprising:

a first water storage vessel, said water storage vessel being vented to atmosphere;

and a fourth piping conduit member having a first end and a second end;

said first end of said fourth piping conduit member being connected to said water storage vessel;

and wherein said fourth piping conduit member is in fluid communication with said first piping conduit member such that said second end of said fourth piping conduit member and said second end of said first conduit member are disposed between said first end of said first conduit piping member and said first end of said fourth piping conduit member.

4. The invention according to claim 3, further comprising:

a first valve member, said first valve member having first, second and third orifices;

said second end of said first conduit member being connected to said first orifice of said first valve member;

said second end of said second conduit member being connected to said second orifice of said first valve member;

and said second end of said fourth conduit member being connected to said third orifice of said first valve member.

5. The invention according to claim 4, further comprising:

second valving means in communication with said first piping conduit member, by which means the rate of flow of water through said first piping conduit member can be regulated;

and wherein said first valve member comprises diverter means, by which means water flowing into said first valve member through said first orifice may alternatively be diverted to exit therefrom only through said second orifice or said third orifice.

6. The invention according to 5 wherein said water discharge fixture is a sink faucet.

7. The invention according to claim 5 wherein said water discharge fixture is a shower head.

* * * * *

UNITED STATES PATENT AND TRADEMARK OFFICE

CERTIFICATE OF CORRECTION

PATENT NO. : 5,524,666

DATED : June 11, 1996

INVENTOR(S) : Mark S. Linn

It is certified that error appears in the above-indentified patent and that said Letters Patent is hereby corrected as shown below:

On the Title Page, Item [57], line 12, "tot he" should read -- to the --.
Column 2, line 67, "fixture" should read -- fixture(s) --.
Column 3, line 1, "bled" should read -- blend --.
Column 3, line 2, "fixture" should read -- fixture(s) --.
Column 3, line 21, "al" should be deleted.
Column 3, line 36, "is a is a" should read -- is a --.
Column 4, line 25, "n" should read -- in --.
Column 6, line 50, "how" should read -- hot --.
Column 7, line 55, "coon" should read -- common --.
Column 9, line 9 "I" should read -- It --.
Column 9, line 57, "tube faucets and shower heads," should read -- tub faucets, shower heads or multiple fixture service, --.
Column 9, line 59, "fixture" should read -- fixture(s) --.
Column 9, line 65, "Operation of Primary and Secondary Water Closets" should read -- Operation of Primary and Secondary Water Closets --.
Column 10, line 30, "connected a" should read -- connected to a --.
Column 12, line 32, "therefrom" should read -- there from --.

UNITED STATES PATENT AND TRADEMARK OFFICE

CERTIFICATE OF CORRECTION

PATENT NO. : 5524666

DATED : June 11, 1996

INVENTOR(S) : Mark S. Linn

It is certified that error appears in the above-indentified patent and that said Letters Patent is hereby corrected as shown below:

ABSTRACT second to the last line ; "closed " should read --closet--
ABSTRACT last line ; "head" should be followed by a period -- . --
Column 1 line 52 "3,11,497" should read -- 3,112,497--
Column 1 line 58 "dirty" should read -- involve --
Column 1 line 58 "waste" should read -- the --
Column 1 line 58 "water" should read -- storage --
Column 1 line 58 period "." should appear as a
left bracket parenthesis -- ( --
Column 1 line 58 "And" should read -- for --
Column 1 line 58 "," should read -- potentially --
Column 1 line 58 "indeed" should read -- long --
Column 1 line 58 "," should read -- periods --
Column 1 line 58 "it" should read -- of --
Column 1 line 58 " is" should read -- time --
Column 1 line 58 " the" should appear as a
right bracket parenthesis -- ) --
Column 1 line 59 "dirty" should read -- of --
Column 1 line 59 "( " should read -- dirty --
Column 1 line 59 "and" should read -- waste --
Column 1 line 59 "in" should read -- water --
Column 1 line 59 "some" should indicate a period -- . --
Column 1 line 59 "involve" should read -- And --
Column 1 line 59 "the" should indicate a coma -- , --
Column 1 line 59 "storage" should read -- indeed --
Column 1 line 59 "(" should indicate a coma -- , --
Column 1 line 59 "for " should read -- it --
Column 1 line 59 "potentially" should read -- is --
Column 1 line 59 " long" should read -- the --
Column 1 line 60 "periods" should read -- dirty --
Column 1 line 60 "of " is should indicate a left bracket parenthesis -- ( --
Column 1 line 60 "time" should read -- and --

UNITED STATES PATENT AND TRADEMARK OFFICE

CERTIFICATE OF CORRECTION

PATENT NO. : 5524666

DATED : June 11, 1996

INVENTOR(S) : Mark S. Linn

It is certified that error appears in the above-indentified patent and that said Letters Patent is hereby corrected as shown below:

Column 1 line 60 ")" should read – in –
Column 1 line 60 "of " should read – some –
Column 1 line 60 "case" should read – cases –
Column 1 line 66 "Corresponding" should read – corresponding–
Column 3 line 45 " System " should read – system–
Column 4 line 26 " n " should read – in--
Column 4 line 50 " Supply " should read – supply–
Column 4 line 52 " System " should read – system–
Column 5 line 33 1/2 " should read – 3/8"–
Column 5 line 33 "or " should read – to –
Column 5 line 34 "nor " should read – to –
Column 5 line 34 1/8 " should read – 5/8"–
Column 7 line 1 " pipe, line " should read – pipeline–
Column 7 line 63 "be" should read – the –
Column 8 line 27 "Particularly, " should read –particularly, –
Column 8 line 33 "nor " should read – to –
Column 8 line 33 1/8 " should read – 5/8"–
Column 8 line 34 "Preferably" should read – preferably--
Column 8 line 35 "Preferably" should read – preferably–
Column 9 line 19, "15" should be removed in its entirety Column 9 line 37 "the" should read – pipe –
Column 9 line 38 " means " should be followed by a coma –, –
Column 9 line 53 " As " should read –as –
Column 9 line 52 1/2 " should read – 3/8"–
Column 9 line 52 "or " should read – to --
Column 9 line 53, "or" should read --to--
Column 9 line 53 3/8 " should read – 5/8"–
Column 9 line 60 " 91 "should read – 13 –

UNITED STATES PATENT AND TRADEMARK OFFICE

CERTIFICATE OF CORRECTION

PATENT NO. : 5,524,666

DATED : Jun. 11, 1996

INVENTOR(S) : Mark S. Linn

It is certified that error appears in the above-indentified patent and that said Letters Patent is hereby corrected as shown below:

Column 11 line 23 "Wherein" should read – wherein–

Signed and Sealed this

Seventeenth Day of June, 1997

*Attest:*

*Attesting Officer*

BRUCE LEHMAN

*Commissioner of Patents and Trademarks*